US008767995B2

(12) United States Patent
Hwang

(10) Patent No.: US 8,767,995 B2
(45) Date of Patent: Jul. 1, 2014

(54) EARPHONE WITH OPEN-CLOSE TYPE ENCLOSURE

(71) Applicant: Feel's Electronics Co., Ltd., Gyeonggi-do (KR)

(72) Inventor: Soon Ahn Hwang, Uiwang-si (KR)

(73) Assignee: Feel's Electronics Co., Ltd., Uiwang-si, Gyeonggi-do (KR)

( * ) Notice: Subject to any disclaimer, the term of this patent is extended or adjusted under 35 U.S.C. 154(b) by 0 days.

(21) Appl. No.: 13/678,285

(22) Filed: Nov. 15, 2012

(65) Prior Publication Data

US 2013/0163804 A1 Jun. 27, 2013

(30) Foreign Application Priority Data

Dec. 27, 2011 (KR) ..... 10-2011-0143063

(51) Int. Cl.
*H04R 25/00* (2006.01)

(52) U.S. Cl.
USPC ..... 381/373; 381/370; 381/371; 381/380

(58) Field of Classification Search
USPC ..... 381/379–380, 370–374; 181/129–130
See application file for complete search history.

(56) References Cited

U.S. PATENT DOCUMENTS

2008/0013773 A1* 1/2008 Yang ..... 381/379
2010/0272303 A1* 10/2010 Lin ..... 381/373

FOREIGN PATENT DOCUMENTS

| | | | |
|---|---|---|---|
| JP | 2008-011487 | A | 1/2008 |
| KR | 20-2003-0038649 | | 3/2004 |
| KR | 10-0496909 | B1 | 6/2005 |
| KR | 10-0999321 | B1 | 12/2010 |
| KR | 10-2011-0125346 | A | 11/2011 |
| KR | 10-1091560 | B1 | 12/2011 |

* cited by examiner

*Primary Examiner* — Matthew Eason
(74) *Attorney, Agent, or Firm* — Juan Carlos A. Marquez; Morris, Manning & Martin, LLP

(57) ABSTRACT

Provided is an earphone with an open-close type enclosure in which it is possible to open or close the communicating hole of the enclosure so as to reinforce the high-pitched tones or low-pitched tones of the sound being listened to. The earphone includes a sound wave generation means 150 that generates sound waves depending on electric signals, a body 100 including an enclosure which encloses the back of the sound wave generation means, and a worn portion 200 in which a sound wave path for transmitting a sound wave to the external auditory canal is formed, and which is worn in the external auditory canal.

5 Claims, 4 Drawing Sheets

EARPHONE WITH OPEN-CLOSE TYPE ENCLOSURE

RELATED APPLICATIONS

This application claims priority from Korean Patent Application No. 10-2011-0143063, filed on Dec. 27, 2011 in the Korean Intellectual Property Office, the entire disclosure of which is incorporated herein by reference.

BACKGROUND OF THE INVENTION

1. Field of the Invention

The present invention relates to an earphone with an open-close type enclosure, and more specifically to an earphone in which it is possible to control the characteristics of the high-pitched and low-pitched tones of the sound waves progressing forward of the sound wave generation means, by controlling the opening and closing for a part of the enclosure, which is the housing enclosing the back of the sound wave generation means such as a speaker.

2. Description of the Related Art

In general, in the sound wave generation means such as a speaker, the vibration generated by the diaphragm is generated backward as well as forward. At this time, in order to improve the characteristics of the sound waves while making the sound waves progress forward only, an enclosure, which is a resonant chamber enclosing the music wave generation means, is provided in the back thereof.

This enclosure, which is also known as a cabinet, box, or the like, is a fixed shape housing enclosed airtightly by a wall formed of wood, metal, resin, or the like, and plays the role of confining, reflecting and amplifying the vibration generated backward of the sound wave generation means to send it forward. If sound waves are produced by operating only the sound wave generation means such as a speaker, the sound volume of low-pitched tones decreases remarkably and the tone quality of high-pitched tones decreases remarkably.

Conventionally, the enclosure was designed in a closed type of housing as much as possible. This is because the higher the sealability, the better the reflectivity and amplification degree of the vibration become.

For instance, Korean Patent Registration No. 10-0999321 discloses an airtight enclosure which is configured by an air cap 100 and a rear cap 200 that enclose a vibration space, which is the space in the back (the upper side in the drawing) of the speaker 700.

Meanwhile, a structure of an earphone, which is configured in such a way that the vibration space in the enclosure and the ambient air communicate at all times because a part of the enclosure is fixed in an open state, is known. This has an advantage of functioning in such a way that outer sounds such as a car horn transmitted from the ambient air are imported inside.

For example, Korean Patent Registration No. 10-1091560 disclose an enclosure which is configured by an upper cover 110 and an upper holder 130 that enclose the vibration space, which is the space in the back (the upper side in the drawing) of a speaker 150, and the vibration space communicates with ambient air at all times by sound exhaust apertures 111 and 131.

Depending on the kind of sound to be listened to, it is necessary to reinforce the high-pitched tones or the low-pitched tones. For instance, it is necessary to listen by reinforcing the high-pitched tones in the case of severe ambient noise, and listen by reinforcing the low-pitched tones in the case of well recorded classical music.

In the enclose disclosed in Korean Patent Registration No. 10-0999321, it is impossible to select high-pitched tones or low-pitched tones by the earphone function alone because the enclosure is completely closed at all times and is of an invariable structure. Further, in the enclose disclosed in Korean Patent Registration Gazette No. 10-1091560, it is impossible to select high-pitched tones or a low-pitched tones by the earphone function alone, since it is impossible to vary the reinforcement state of the high/low pitched tones determined by the size and position of the opened sound exhaust apertures 111 and 131, because the enclosure is open at all times and is of an invariable structure.

SUMMARY OF THE INVENTION

Accordingly, it is an object of the present invention to provide an earphone with an open-close type of enclosure in which the communicating hole of the enclosure can be opened or closed so as to reinforce the high-pitched tones or the low-pitched tones of the sound being listened to.

To achieve the above object, there is provided an earphone including: a sound wave generation means which generates sound waves depending on electric signals; a body including an enclosure which encloses the back of the sound wave generation means; and a worn portion in which a sound wave path for transmitting a sound wave to the external auditory canal is formed, and which is worn in the external auditory canal, wherein a communicating hole is formed in the enclosure so as to communicate with ambient air, and a open-close cap is mounted on the enclosure so as to open and close the communicating hole, an axial hole is formed in the body, an axis inserted into the axial hole is formed on a side of the open-close cap, an adhered plane adherable to the communicating hole is provided in at least one part of the plane of the open-close cap facing the communicating hole, and the adhered plane opens and closes the communicating hole according to the adhered plane's approach to and separation from the communicating hole.

Preferably, the axis can slide with respect to the axial hole in axial direction, and the adhered plane is approached to and separated from the communicating hole by the axial movement of the open-close cap.

Preferably, the axial hole and the axis are screwed to each other, and the adhered plane is approached to and separated from the communicating hole by the rotation of the open-close cap.

Preferably, the axial hole and the axis are rotatable with respect to each other, at least one adhered plane formed at the axial position adherable to the communicating hole, and at least one separated plane formed at the axial position separated from the communicating hole are provided on a plane of the open-close cap facing the communicating hole, and the adhered plane is positioned at a position of the communicating hole by rotation of the open-close cap, so that the adhered plane approaches to the communicating hole; and the separated plane is positioned at the position of the communicating hole, so that the adhered plane is separated from the communicating hole.

Preferably, a dome shaped protrusion corresponding to the position and size of the communicating hole is formed on the adhered plane, and when the adhered plane approaches to the communicating hole, at least one part of the protrusion is inserted into the communicating hole simultaneously.

Preferably, at least one recess, which is a concave slot to which the protrusion that slipped out of the communicating hole during the rotation of the open-close cap is joined, is formed on an outer surface closed from ambient air in the enclosure.

According to the earphone with an open-close type of enclosure of the present invention, the communicating hole of the enclosure can be opened or closed so as to reinforce the high-pitched tones or the low-pitched tones of the sound being listened to.

Further, by opening or closing the communicating hole of the enclosure according to the approach to and separation from the adhered plane, it is possible to aim at a definite open-close effect by the plane contact.

In addition, plane contact can be implemented by selection of an adhered plane and a separated plane by rotation as well as axial sliding movement or axial movement according to screw rotation, and a reliable sealability and click feel can be felt when closed by a dome shaped protrusion formed on the contact plane, and definite confirmation of the open position and a click feel can be felt when the protrusion is joined by the recess formed in the portion other than the communicating hole.

BRIEF DESCRIPTION OF THE DRAWINGS

The above and other objects, features and other advantages of the present invention will be more clearly understood from the following detailed description taken in conjunction with the accompanying drawings, in which.

EXPLANATION OF REFERENCE NUMERALS OF MAIN PARTS OF THE DRAWINGS

Figure 1:
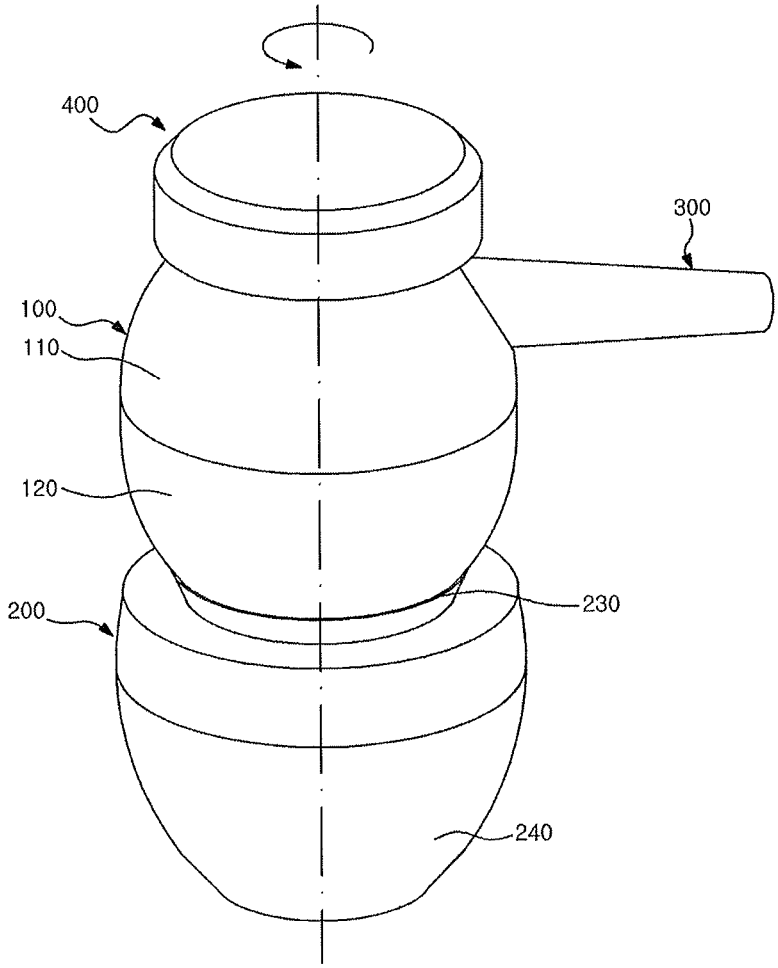
FIG. 1 is a view showing the exterior of an earphone with an open-close type of enclosure according to an embodiment of the present invention.

100: body, 110: upper cover
111: axial hole, 112: communicating hole
113: recess, 119: cord hole
120: lower cover, 122: sliding portion
140: mounting plate, 150: sound wave generation means
200: worn portion, 220: inner holder
230: cushion holder, 240: cushion
300: cord part, 400: open-close cap
401: axis, 402: adhered plane
402*a*: dome shaped protrusion, 403: separated plane
G: gap
S1: vibration space, S2: sound wave space

DETAILED DESCRIPTION OF THE INVENTION

Hereinafter, an earphone with open-close type enclosure of the present invention will be described in more detail with reference to specific embodiments. The same or similar components having the same functions may be designated by the same or similar reference numerals although they are illustrated in different drawings. Thus, repeated description thereof will be omitted.

Figure 2:
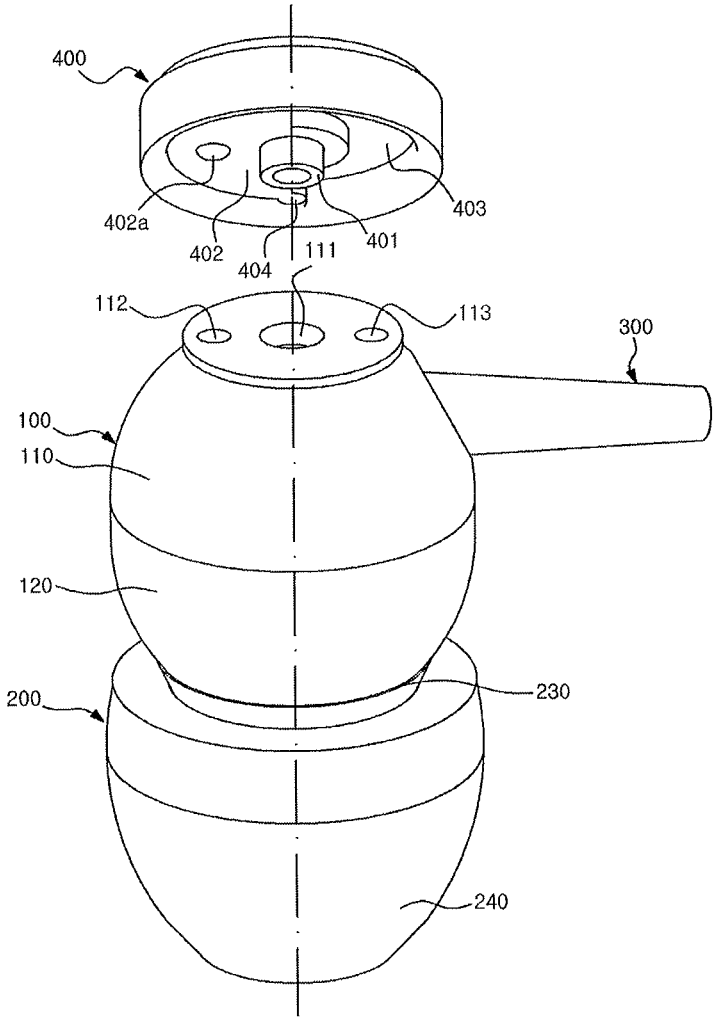
FIG. 2 is an exploded perspective view showing the major parts of the earphone shown in FIG. 1.
Figure 3:
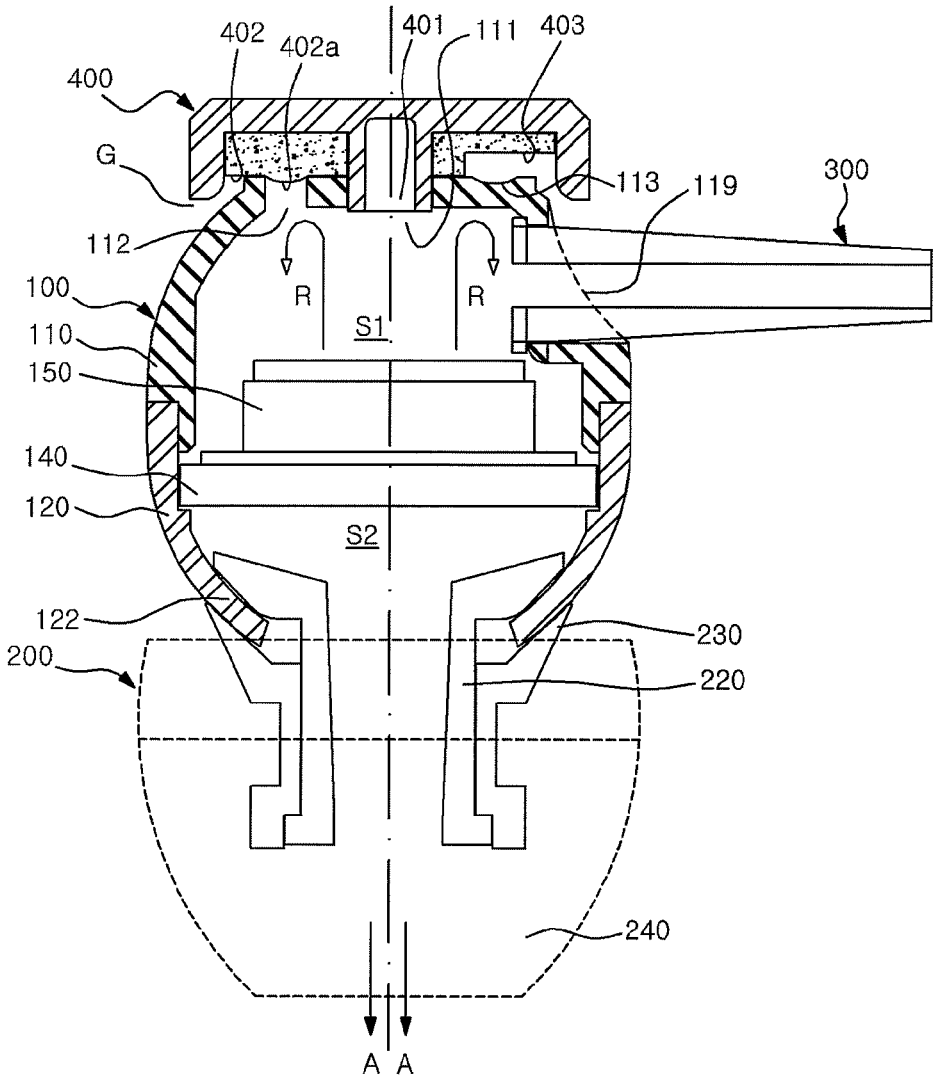
FIG. 3 is a sectional view for describing the operation and effect of the state in which a vibration space is shielded from the outside.
Figure 4:
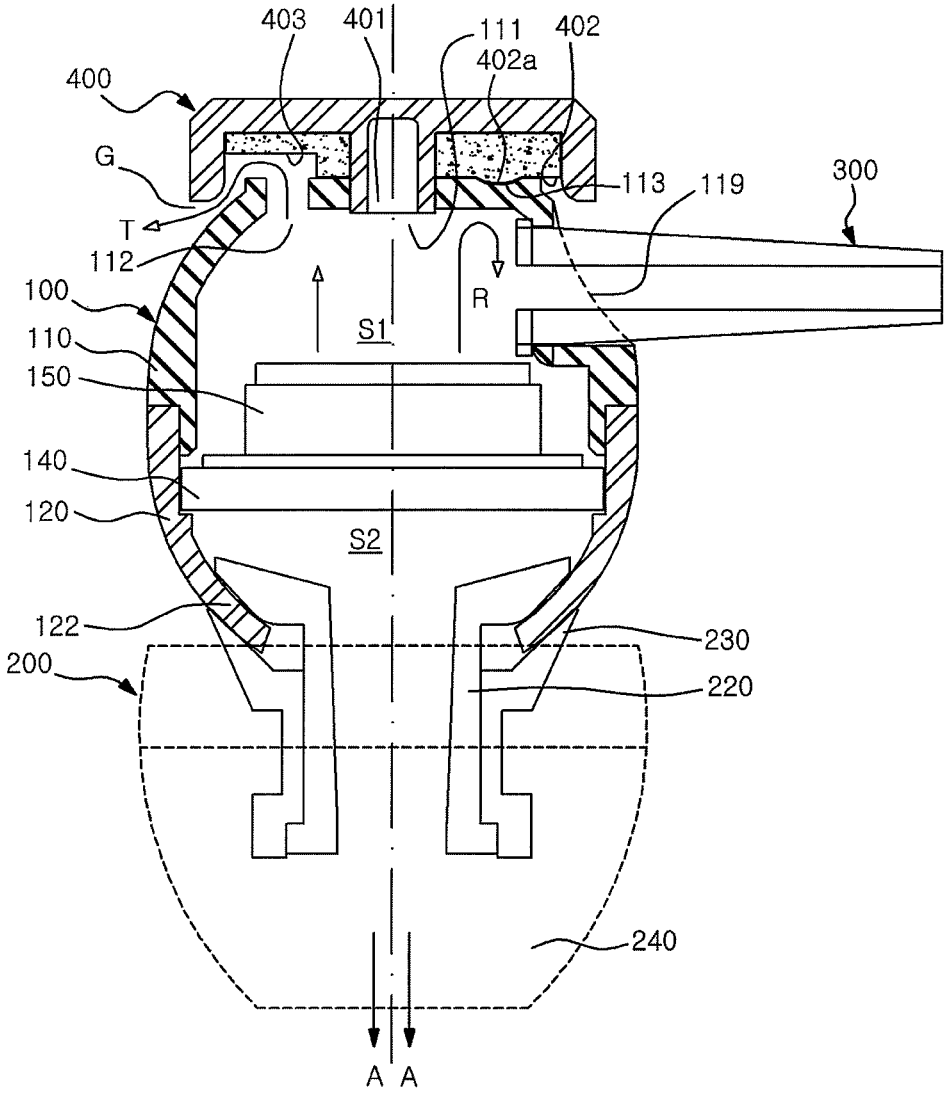
FIG. 4 is a sectional view for describing the operation and effect of the state in which the vibration space communicates with the outside.

FIG. 1 is a view showing the exterior of an earphone with an open-close type of enclosure according to an embodiment of the present invention, FIG. 2 is an exploded perspective view showing the major parts of the earphone shown in FIG. 1, FIG. 3 is a sectional view for describing the operation and effect of the state in which a vibration space is shielded from the outside; and FIG. 4 is a sectional view for describing the operation and effect of the state in which the vibration space communicates with the outside.

Basic Configuration

The earphone with an open-close type of enclosure according to an embodiment of the present invention includes a body 100, a sound wave generation means 150, and a worn portion 200.

The sound wave generation means 150 is a means for generating sound waves depending on electric signals like a speaker, etc. The sound wave generation means 150 can be mounted immovably on the inside of the body 100 using a mounting plate 140, for example.

The body 100 is a housing including an enclosure that encloses a vibration space S1, which is the back of the sound wave generation means 150. The front of the sound wave generation means 150 is a sound wave space S2 in which the sound waves to be transmitted to the external auditory canal depart, and the front of the sound wave space S2 is a sound wave path, which is a path through which the sound waves propagating the worn portion 200 are transmitted. A cord hole 119, in which a cord part 300 through which a cord (not shown) for supplying electrical signals to the sound wave generation means 150 passes is inserted, is formed in the body 100. The body 100 may be fabricated in division into an upper cover 110 and a lower cover 120 for the convenience of assembling internal components, but the present invention is not limited thereto. In the illustrated example, the whole of the upper cover 110 and a part of the top end portion of the lower cover 120 are used as the enclosure.

The worn portion 200 includes a sound wave path for transmitting sound waves to the external auditory canal, and is a part to be worn in the external auditory canal. The worn portion 200 includes a cushion 240 made of elastic material having flexibility for maintaining the inserted state of the earphone by friction in direct contact with the external auditory canal, and a cushion holder 230 for supporting the cushion 240. However, for the tilting motion of the worn portion 200 with respect to the body 100, it may be configured in such a way that the cushion holder 230 and an inner holder 220 are joined by a stepped portion, in a state in which the cushion holder 230 is in sliding contact with the outer surface of the sliding portion 122, which is the front end of the lower cover 120, and the inner holder 220 is in sliding contact with the inner surface of the sliding portion 122.

Here, the earphone with an open-close type of enclosure of the present invention is characterized by including a communicating hole 112 and an open-close cap 400.

The communicating hole 112 is a hole formed in the enclosure to communicate with ambient air. The size (the diameter) of the communicating hole 112 is determined by considering the amplitude and frequency characteristics relying on the material and shape of the enclosure, and under the same conditions, the high-pitched tones are reinforced according as the size decreases, and the low-pitched tones are reinforced according as the size increases. Further, the formation position of the communicating hole 112 is the adhered portion of the open-close cap 400, for example, the position corresponding to the adhered plane to be described later.

The open-close cap 400 is a member for opening or closing the communicating hole 112. Axial motion around the axis, axial motion by a screw motion, rotary motion using a partially closed plane, etc. are taken as types of operation for opening and closing. But the present invention is not limited thereto, and opening and closing by horizontal sliding movement with respect to the communicating hole 112, swing-type opening and closing with a hinge near the communicating hole 112 taken as the axis etc. can be applied.

By the above-described configuration, the communicating hole 112 of the enclosure is opened or closed by the open-close cap 400 to communicate with or be shut off from ambient air. In addition, if the communicating hole 112 is closed, the vibration that has progressed to the back of the sound wave generation means 150 is entirely reflected R on the inner wall of the enclosure, so that the low-pitched tones are reinforced, as shown in FIG. 3. Further, if the communicating hole 112 is opened, the vibration that has progressed to the back of the sound wave generation means 150 is partly reflected R on the inner wall of the enclosure, but a part of it communicates T with ambient air through the communicating hole 112 and a gap G formed between the body 100 and the open-close cap 400, so that the low-pitched tones are weakened and the high-pitched tones are relatively reinforced.

Accordingly, to reinforce the high-pitched tones of the sound to be listened to, the amplitude of the low-pitched tones are abated by opening the communicating hole 112, and to reinforce the low-pitched tones of the sound to be listened to, the amplitude of the high-pitched tones can be abated by closing the communicating hole 112.

Plane Contact Adherence Open-Close Structure Using an Axis

In the basic configuration described above, as an open-close mechanism considering the small size of the earphone, an axial hole 111 is formed in the body 100 or the enclosure, and an axis 401 inserted into the axial hole 111 is formed on a side of the open-close cap 400. Further, in the open-close cap 400, it is preferable that an adhered plane 402 adherable to the communicating hole 112 is formed on at least one part of the plane facing the communicating hole 112 (the lower plane of the open-close cap 400 in the illustrated example).

At this time, it is preferable that the communicating hole 112 be opened or closed according to the adhered plane's 402 approach to and separation from the communicating hole 112. Preferably, the portion composing the thickness portion of the adhered plane 402 is achieved of material having elasticity and restorability such as foamable resin, and the surface of the adhered plane 402 is coated with material having flexibility and abrasion resistance. Therefore, the sealability during closing can be improved.

Therefore, it is possible to reliably seal because the communicating hole 112 is closed as the adhered plane 402 with a size and shape adherable to it approaches to the communicating hole 112, which is an aperture having a predetermined size. In addition, it is possible to reliably open because the communicating hole 112 is opened as the adhered plane 402 is separated therefrom.

Embodiments of Approach and Separation Using an Axis

Below, several embodiments with regard to approach and separation using the axis will be described.

As a first embodiment, the axis 401 can be configured slidably in the axial direction for the axial hole 111. At this time, it is preferable that a stopper (not shown) that prevents the axial hole 111 from slipping out when the axis 401 is separated to the maximum be installed at the front end (the lower end in the illustrated example).

At this time, the open-close cap 400 can be advanced or retreated in the axial direction by sliding together with the axis 401, and the adhered plane 402 can be close to or away from the communicating hole 112 by the axial movement.

As a second embodiment, the axial hole 111 and the axis 401 may be configured so as to be screwed to each other. In the illustrated example, a screw is not shown, but a female screw may be formed in the axial hole 111 and a male screw may be formed on the axis 401.

At this time, the axis 401 is rotated by the rotation of the open-close cap 400, and the axis 401 can be advanced and retreated in the axial direction with respect to the axial hole 111. Accordingly, advance and retreat in the axial direction of the open-close cap 400 is achieved. Thus, the adhered plane 402 can be close to or away from the communicating hole 112.

As a third embodiment, the axial hole 111 and the axis 401 can be configured rotatably to each other. At this time, they can be configured in such a way that the axial position between the open-close cap 400 and the communicating hole 112 can maintain a fixed relation even if they are rotated. For this, stoppers (not shown) may be provided respectively on the outer periphery of the axis 401 corresponding to the front and back of the axial hole 111.

In addition, in the open-close cap 400, at least one separated plane 403 formed in the axial direction separated from the communicating hole 112 can be provided on the plane facing the communicating hole 112 (the lower plane of the open-close cap 400 in the illustrated example), together with at least one adhered plane 402 formed in the axial direction adherable to the communicating hole 112. That is, since the relation of axial position between the open-close cap 400 and the communicating hole 112 is fixed, the adhered plane 402 becomes a plane protruding toward the communicating hole 112, and the separated plane 403 becomes a plane positioned far from the communicating hole 112. The interface between the adhered plane 402 and the separated plane 403 may be formed so as to make a stepped portion as in the illustrated example. But the present invention is not limited thereto, and it may be formed of a curved plane smoothly linking the surface of the adhered plane 402 and the surface of the separated plane 403.

At this time, since the axial positional relation between the open-close cap 400 and the communicating hole 112 is fixed, the adhered plane 402 and the separated plane 403 face the communicating hole 112 alternately by the rotation of the open-close cap 400. Thus, the adhered plane 402 is positioned at the position of the communicating hole 112, so that approach of the adhered plane 402 to the communicating hole 112 is achieved; and the separated plane 403 is positioned at the position of the communicating hole 112, so that the adhered plane 402 can be separated from the communicating hole 112.

Embodiment For Improving Sealing Function, Opening Function and Click Feel by Using the Rotary Axis.

As described above, the third embodiment is a configuration for rotating around the axis, so the axial relational position between the open-close cap 400 and the communicating hole 112 is invariable. By making use of such a characteristic, it is possible to enhance convenience of use by improving the click feel, while ensuring sealability and openness.

For this purpose, it is preferable to configure in such a way that a dome shaped protrusion **402*a* corresponding to the position and size of the communicating hole 112 is formed on the adhered plane 402. The protrusion 402*a* is a structure to be inserted into the communicating hole 112; when it is separated from the communicating hole 112 by external force importing rotation to the open-close cap 400, it is deformed by the sliding motion and elasticity of the inclined plane of dome shape and the peripheral edge of the communicating hole 112. After the protrusion 402*a* is separated from the communicating hole 112, it moves on the plane portion of the enclosure leading from the communicating hole 112. And then, when it reaches the communicating hole 112 again to be inserted thereinto, insertion is accelerated by the sliding motion and the restoration strain by elasticity of the inclined plane of dome shape and the peripheral edge of the communicating hole 112, so that insertion is achieved along with a click feel. Here, for the strain by elasticity, at least one of the protrusion 402***a*, the adhered plane 402 and the open-close cap 400 may be made of elastic material.

However, the size of the maximum diameter portion of the protrusion 402*a* may be greater than that of the communicating hole 112. Here, the protrusion 402*a* has only a part thereof inserted into the communicating hole 112.

Therefore, simultaneously when approach of the adhered plane 402 to the communicating hole 112 is achieved, at least a part of the protrusion 402*a* can be inserted into the communicating hole 112. Accordingly, more secure sealing than the sealing by the adhered plane 402 of a simple plane is possible, and a click feel by elasticity can be secured during insertion.

Meanwhile, it is preferable that at least one recess 113, which is a concave slot to which the protrusion 402*a* slipping out of the communicating hole 112 during the rotation of the open-close cap 400 can be joined, be formed on an outer surface closed from ambient air in the enclosure (that is, the portion not communicating with ambient air). That is, as shown in FIG. 4, when the communicating hole 112 is opened, the protrusion 402*a* can be joined to the recess 113 formed at a predetermined position. The position and number of the recesses 113 may be plural. In addition, the operation during the protrusion's 402*a* insertion into and breakaway from the recess 113 is the same as the operation during the protrusion's 402*a* insertion into and breakaway from the communicating hole 112, so a detailed description thereof is omitted.

Therefore, after the communicating hole 112 is opened, the protrusion 402*a* can be joined with one or more predetermined recesses 113. Thus, based on the position of joining and/or the number of joining, it is possible to know how many rotations and how much degree of openness were achieved after the opening of the communicating hole 112, and at the time of joining with each recess 113, it is possible to secure a click feel by elasticity.

The present invention can be applied to an earphone in which the characteristics of the high-pitched and low-pitched tones of the sound waves progressing forward of the sound wave generation means can be controlled by controlling the opening and closing for a part of the enclosure, which is a housing enclosing the back of the sound wave generation means such as a speaker.

While the present invention has been described with reference to the preferred embodiments, it will be understood by those skilled in the related art that various modifications and variations may be made therein without departing from the scope of the present invention as defined by the appended claims.

What is claimed is:

1. An earphone comprising:

a sound wave generation means which generates sound waves depending on electric signals;

a body including an enclosure which encloses the back of the sound wave generation means; and a worn portion in which a sound wave path for transmitting a sound wave to the external auditory canal is formed, and which is worn in the external auditory canal, wherein a communicating hole is formed in the enclosure so as to communicate with ambient air, and a open-close cap is mounted on the enclosure so as to open and close the communicating hole, an axial hole is formed in the body, an axis inserted into the axial hole is formed on the open-close cap, an adhered plane adherable to the communicating hole is provided in at least one part of the plane of the open-close cap facing the communicating hole, the adhered plane opens and closes the communicating hole according to the adhered plane's approach to and separation from the communicating hole a dome shaped protrusion corresponding to the position and size of the communicating hole is formed on at least one adhered plane formed at the axial position adherable to the communicating hole, and when the adhered plane approaches to the communicating hole, at least one part of the protrusion is inserted into the communicating hole simultaneously.

2. The earphone according to claim 1, wherein the axis can slide in axial direction with respect to the axial hole, and the adhered plane is approached to and separated from the communicating hole by the axial movement of the open-close cap.

3. The earphone according to claim 1, wherein the axial hole and the axis are screwed to each other, and the adhered plane is approached to and separated from the communicating hole by the rotation of the open-close cap.

4. The earphone according to claim 1, wherein the axial hole and the axis are rotatable with respect to each other, and at least one separated plane formed at the axial position separated from the communicating hole are provided on a plane of the open-close cap facing the communicating hole, and the adhered plane is positioned at a position of the communicating hole by rotation of the open-close cap, so that the adhered plane approaches to the communicating hole; and the separated plane is positioned at the position of the communicating hole, so that the adhered plane is separated from the communicating hole.

5. The earphone according to claim 1, wherein at least one recess, which is a concave slot to which the protrusion that slipped out of the communicating hole during the rotation of the open-close cap is joined, is formed on an outer surface closed from ambient air in the enclosure.

* * * * *